US006834889B2

(12) United States Patent
Sunde et al.

(10) Patent No.: US 6,834,889 B2
(45) Date of Patent: Dec. 28, 2004

(54) TORQUE RELEASE COUPLING FOR USE IN DRILL STRINGS

(75) Inventors: Egil Sunde, Sandnes (NO); Morten Hyvik, Stavanger (NO); Per Olav Haughom, Tonstad (NO)

(73) Assignee: Den norske stats oljesselskap A.S., Stavanger (NO)

( * ) Notice: Subject to any disclaimer, the term of this patent is extended or adjusted under 35 U.S.C. 154(b) by 84 days.

(21) Appl. No.: 10/168,827

(22) PCT Filed: Dec. 22, 2000

(86) PCT No.: PCT/NO00/00449

§ 371 (c)(1),
(2), (4) Date: Sep. 27, 2002

(87) PCT Pub. No.: WO01/49967

PCT Pub. Date: Jul. 12, 2001

(65) Prior Publication Data

US 2003/0188894 A1 Oct. 9, 2003

(30) Foreign Application Priority Data

Dec. 28, 1999 (NO) ..... 19996530

(51) Int. Cl.[7] ..... F16L 55/00

(52) U.S. Cl. ..... 285/92; 285/81; 285/317; 464/21; 166/175; 166/320; 166/321

(58) Field of Search ..... 464/18, 19, 20, 464/21, 37, 38, 39; 166/175, 320, 321; 285/92, 922, 81, 84, 86, 307, 317, 333, 390, 355

(56) References Cited

U.S. PATENT DOCUMENTS 2,118,350 A * 5/1938 Holt ..... 285/333
2,202,261 A * 5/1940 Osmun ..... 285/81
2,307,275 A * 1/1943 Johnson ..... 285/922
2,940,730 A * 6/1960 McClintock et al. ..... 285/922
3,866,746 A * 2/1975 Curington ..... 464/18
3,942,337 A 3/1976 Leonard et al.
4,721,492 A 1/1988 Maurer
4,877,086 A * 10/1989 Zunkel ..... 166/321
5,137,087 A 8/1992 Szarka et al.
5,947,214 A 9/1999 Tibbitts
6,082,457 A * 7/2000 Best et al. ..... 464/18
6,279,962 B1 * 8/2001 McGarian et al. ..... 285/307
6,293,344 B1 * 9/2001 Nixon et al. ..... 166/321

FOREIGN PATENT DOCUMENTS

CH 662859 A5 * 10/1987
EP 0361730 A1 * 4/1990

* cited by examiner

*Primary Examiner*—Eric K. Nicholson
*Assistant Examiner*—Aaron Dunwoody
(74) *Attorney, Agent, or Firm*—Foley & Lardner LLP

(57) ABSTRACT

This invention relates to a torque release coupling for use in drill strings comprising an outer string part (1) rotatably mounted outside a radially inner string part (2), and a rotation lock (3) positioned between them. The rotation lock (3) is coupled to a first of said string parts (1, 2) with a coupling device (4, 9) adapted to allow axial shifts relative to the first string part, and comprising axial gripping organs (5) adapted for releasable engagement with cooperating gripping organs in the second string part, the rotation lock (3) comprising a spring (6) or similar adapted to apply an axial force on the rotation lock (3) directed against the cooperating gripping organs (5) from the first string part.

11 Claims, 3 Drawing Sheets

TORQUE RELEASE COUPLING FOR USE IN DRILL STRINGS

CORRESPONDING RELATED APPLICATIONS

This application is a U.S. National Phase Application of PCT/NO00/00449 filed on Dec. 22, 2000, claiming priority to Norwegian Application No. 19996530 filed on Dec. 28, 1999.

BACKGROUND OF THE INVENTION

This invention relates to a torque release coupling for use in drill strings comprising an outer string part rotatably mounted outside a radially inner string part, and a momentum limited rotation lock positioned between them.

In drilling operations, especially related to oil and gas production, long drill strings are used penetrating different types of geological formations with varying hardness and drilling resistance. The drill strings may consist of a number of sections with decreasing diameter downward in the drilled hole, and thus it is difficult to decide how large of a momentum the drill string may be subjected to during drilling. If the momentum is too large the drill string may be subject to damage, e.g. in the joints in the drill string, which results in that it must be removed from the drilled hole to be repaired. This is related to delays and large costs.

These problems may be solved using torque release couplings positioned along the drill string hindering that torque over a certain limit is transmitted along the string. A number of devices for obtaining such couplings are known, comprising two parts rotating relative to each other with a rotation limiter between them, but none of these have been usable in practice. Thus there are no such devices available at this time.

The rotation limiting devices may be breakable bolts being adapted to break when the torque exceeds a certain limit. This solution has the disadvantage that the bolt must be replaced after use, so that the drilling still has to be interrupted. The damage to the coupling is, however, limited.

Another type of a rotation limiting device is friction surfaces being held together with a force. This solution does, however, have the disadvantage that the friction is difficult to predict in practice, and will also change for each time the coupling has been in action.

In EP 151,365 a solution is described in which a split ring is positioned between an upper and a lower part of the drill string and is fastened in the first part with a locking pin, the split ring being adapted to rotate relative to the second part if the torque exceeds a certain limit. This represents a rather complicated solution which also is based on the difficulty in predicting the friction between the parts of the coupling.

U.S. Pat. No. 5,137,087 describes a cementing tool with a torque release coupling comprising a sheath with a number of teeth with inclined side surfaces being held together by a spring. When the coupling is subject to a sufficiently large torque the axial force exceeds the spring force and the two parts may rotate relative to each other. This is, however, a tool being meant for temporary positioning in the well and must be pulled out of the well afterwards. Thus it is not suitable for use as a part of the drill string, where stricter requirements must be held to the repeatability of the coupling and the coupling must allow fluids from the well to flow through it.

It is thus an object of this invention to provide a torque release coupling as described above in which the release torque is predictable and reproducible, based on a relatively simple design. The invention is characterized as stated in the independent claim.

BRIEF DESCRIPTION OF THE DRAWINGS

The invention will be described below with reference to the accompanying drawings, illustrating an example of a preferred embodiment of the invention.

DETAILED DESCRIPTION OF THE PREFERRED EMBODIMENTS

Figure 1:
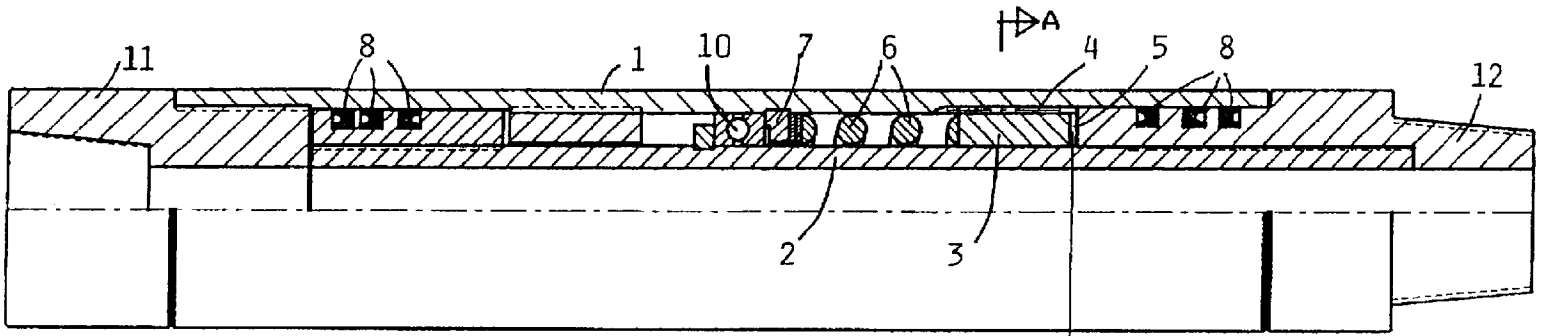
FIG. 1 shows a partial longitudinal section of a torque coupling according to the invention.
Figure 2:
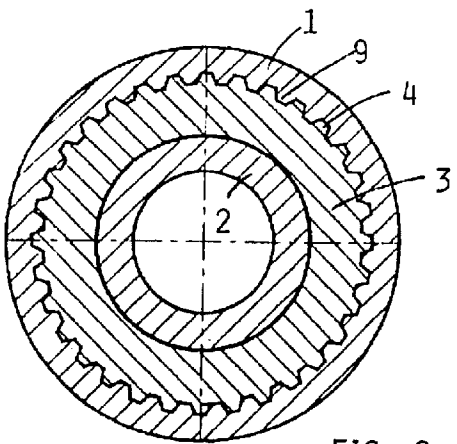
FIG. 2 shows a cross section of the torque coupling in FIG. 1 as taken along the line A—A.

The torque release coupling shown in FIG. 1 shows a torque release coupling for drill strings comprising an outer string part 1 comprising threads or similar in its upper part 11 for connecting to the drill string and an inner cylindrical part 2 comprising threads or similar 12 for coupling to the lower part of the drill string 12. The inner and the outer string part is rotationally locked to each other through a rotation lock 3, here consisting of a moveable, cylindrical toothed wheel 3 being rotationally locked to the outer part 1 through a radially oriented gear rim 4 (see FIG. 2), and with a releasable rotation lock to the inner string part 2 through an axially oriented gear rim 5 engaging into a corresponding gear rim in the inner part 2 (see FIG. 3).

The inner cylindrical part 2 as an opening being as equal to the diameter of the drill string 12 as possible so as to avoid pressure drop in mud through-put.

The axially directed gear rim is provided with teeth having, in the axial direction, an angle V relative to the tangential direction being less than 90°. A spring 6 related to a fastening point 7 being positioned in a chosen axial position in the inner and/or outer part is provided to provide an axial force on the toothed wheel toward the corresponding part of the inner string part, so that a force of a chosen amplitude is required to allow a relative rotation between the toothed wheel and the inner part 2, and thus between the inner and the outer string parts.

In use the provided torque is transferred through the coupling until it exceeds the forces required to shift the toothed wheel against the spring force. When this limit is reached the inner and the outer parts of the torque release coupling will rotate relative to each other, until the torque is again decreased, or possible until the lower part of the drill string may rotate easier again.

Figure 6:
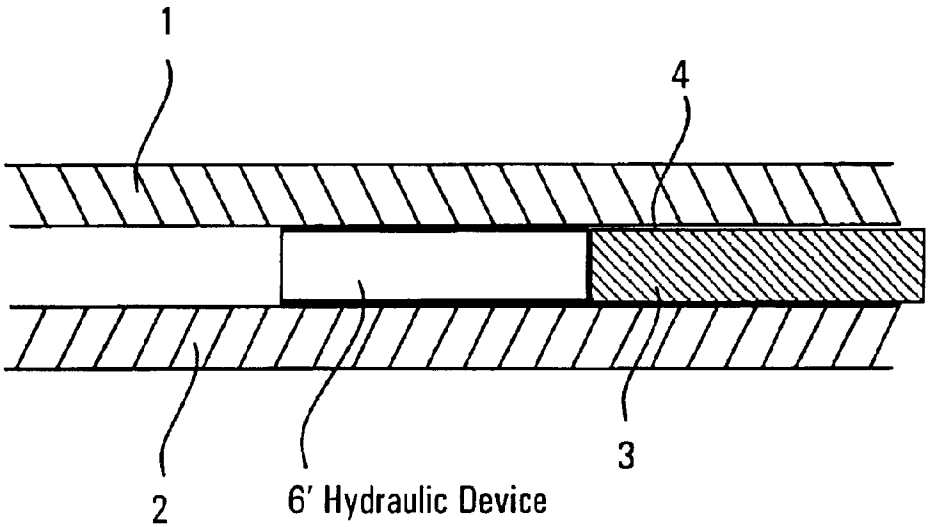
FIG. 6 shows a hydraulic device utilized in place of the mechanical spring shown in FIG. 1.

The power required to obtain a rotation between the toothed wheel and the inner part will thus depend on the provided spring force, and to some degree to the angle V of the sides of the axially directed teeth 5. According to a preferred embodiment of the invention the spring force may be adjusted, either, if the spring is a spiral spring, by changing the fastening point 7 of the spring or, if the spring 6 is a hydraulic device (see element 6' in FIG. 6), by increasing the hydraulic pressure in the hydraulic device. In the case in which the spring is mechanical, the fastening point 7 may of course be connected to a hydraulic device adapted to shift the springs fastening point 7 relative to the inner and outer string parts. The angle will in a preferred embodiment be in the range of 60° from the perpendicular direction, or 30° from the axial direction, but this may depend on a number of things.

Because of the use in drill strings packings, bearings and fastening devices in the torque release coupler should be prepared to withstand large strains, like an axial strain of 2170 kN, an Axial pressure of 200 kN and a pressure difference from inner to outer pressure of 350 bar.

In an example of an embodiment of the invention with the above-mentioned angle the spring force will be in the range of 20 kN and provide/require a torque of 40 kNm for rotating the torque release coupling. As mentioned above the spring force may be adjusted, i.e. depending on the friction, which again depends on the chosen materials. Usually acid resistant steel will be preferred. Typical dimensions for this embodiment is a depth of the teeth in the gripping organs or elements (members) of 5 mm and a thickness of 20 mm in a torque release coupling with 165 mm outer diameter and 50 mm inner diameter.

The rotation lock 3 may be made in alternative ways, for example regarding the radial gear rim 4 being engaging into the outer string part 1, which per se may have any non-circular shape hindering rotation between the parts. Also the axial gear rim 5 may in some cases be provided with different shapes, for example for if an nonlinear slip is required or to give easier slip in one direction than the other.

The torque release coupling shown in FIG. 1 comprises in addition in a per se known way packings 8, which together with the string parts provide a closed room containing the coupling mechanism. These packings 8 avoids intrusion of well fluids into the coupling mechanism. According to a preferred embodiment the room containing the coupling mechanism will also be filled with oil or similar, so that the friction may be secured in an even more predictable way and to reduce the wear between the parts. Of the latter reason the inner 2 and the outer 1 pipe parts may be rotatably coupled together using one or more ball bearings 10.

Figure 5:
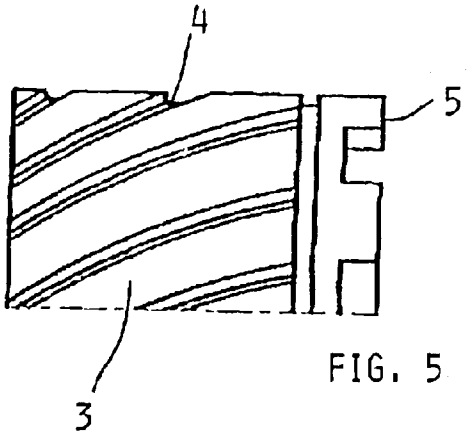
FIG. 5 shows a part of the outer surface of the coupling part according to the same embodiment of the invention as is illustrated in FIG. 4.
Figure 4:
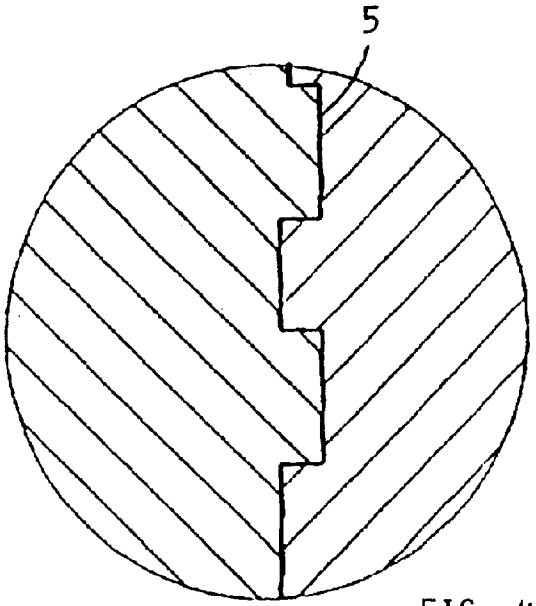
FIG. 4 shows an alternative embodiment of the coupling part in FIG. 3.

FIGS. 4 and 5 illustrate an alternative embodiment of the invention in which the angle V of the teeth 5 is 90°. In this case the radial gear rim 4 is provided with an angle relative to the longitudinal direction, as shown in FIG. 5. At a forced torque from the corresponding gear rim 9 of the outer pipe part 1 on the radial gear rim will have a certain angle relative to this, give a force component pushing the rotation lock and thus give the radially directed gear rim 5 from the corresponding gripping elements from the inner pipe part 2. In this case it is the angle of the radial gear rim which together with stiffness of the spring 6 defines the limit for when the torque release coupling according to the invention will be released. This embodiment of the invention will only release the torque coupling in one of the rotational directions.

Figure 3:
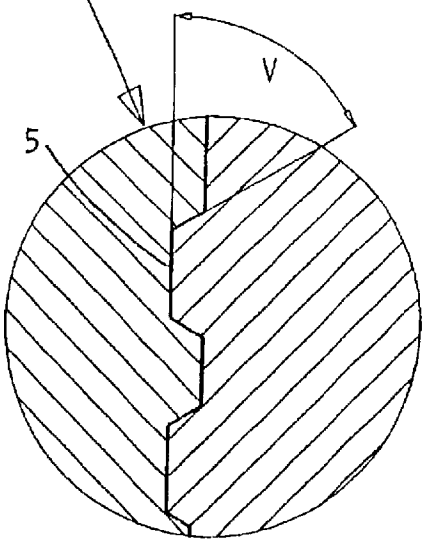
FIG. 3 shows a detail of a tangential section of the coupling part of the torque release coupling shown in FIG. 1.

The solution being illustrated in FIG. 5 may of course be used in combination with the solution shown in FIG. 3, in which the gripping elementss comprises side surfaces with angles less than 90°.

In the figures the rotation lock 3 has an inner cylindrical surface which may rotate freely relative to a corresponding inner surface on the inner string part 2. Different types of bearing may be contemplated, as the purpose is that the rotation lock, when the chosen torque is exceeded, should rotate relatively freely relative to the inner string part 2. In some cases it may, however, be contemplated that a chosen amount of frictional resistance is provided to reduce this rotation slightly, so that the recoupling may happen earlier than it otherwise would.

What is claimed is:

1. Torque release coupling for use in drill strings comprising:

a radially outer string part rotatably mounted outside a radially inner string part; and a rotation lock positioned between the outer string part and inner string part, wherein the rotation lock is fastened to a first of said string parts with a coupling device adapted to allow axial movement of the rotation lock relative to the first string part, wherein the rotation lock comprises axially oriented gripping organs adapted to releasable engage into corresponding gripping organs in a second of the string parts, the rotation lock also comprising a spring to provide an axial force on the rotation lock and to bias the gripping organs on the rotation lock into engagement with the gripping organs on the second of the string parts, wherein the gripping organs of the rotation lock and the corresponding gripping organs of the second string part have angled engaging surfaces that are configured such that when a relative moment between the first of the string parts and the second of the string parts, reaches a predetermined value, an axial force sufficient to overcome the bias of the spring is produced, and the rotation lock is moved to a position wherein interlocking between the first of the string parts and the second of the string parts, by the rotation lock, is released, and wherein the torque release coupling has an annular main shape to allow through flow of fluids and being provided in its upper and lower parts with coupling means for connecting to parts of a drill string.

2. Torque release coupling according to claim 1, wherein at least one of the gripping organs comprises axially oriented teeth having side edges with an angle relative to the tangential direction being less than 90°.

3. Torque release coupling according to claim 1, wherein the coupling device comprises a radially oriented gear rim on the rotation lock and corresponding recesses on the corresponding string part.

4. Torque release coupling according to claim 3, wherein the radially oriented gear rim has an angle relative to the longitudinal direction.

5. Torque release coupling according to claim 1, wherein the rotation lock is coupled to the radially outer string part, and engages into the radially inner part through the gripping organs.

6. Torque release coupling for use in drill strings comprising:

a radially outer string part rotatable mounted outside a radially inner string part; and a rotation lock positioned between the outer string part and inner string part, wherein the rotation lock is fastened to a first of said string parts with a coupling device adapted to allow axial movements relative to the first string part, wherein the rotation lock comprises axially oriented gripping organs adapted to releasable engage into corresponding gripping organs in the second string part, the rotation lock also comprising a spring to provide an axial force on the rotation lock oriented from the first string part toward the corresponding gripping organs, wherein the torque release coupling has an annular main shape to allow through flow of fluids and being provided in its upper and lower parts with coupling means for connecting to parts of a drill string, wherein the rotation lock is coupled to the radially outer string part, and engages into the radially inner part through the gripping organs, and wherein the inner string part extends through the rotation lock and the spring, and wherein the torque release coupling comprises at least one packing on each side of the rotation lock and the spring to create a tight coupling between the inner and the outer string parts on both sides of the rotation lock.

7. Torque release coupling according to claim 1, wherein the spring is a hydraulic device.

8. Torque release coupling according to claim 1, wherein the spring is a mechanical spring.

9. Torque release coupling for use in drill strings comprising:

a radially outer string part rotatable mounted outside a radially inner string part; and a rotation lock positioned between the outer string part and inner string part, wherein the rotation lock is fastened to a first of said string parts with a coupling device adapted to allow axial movements relative to the first string part wherein the rotation lock comprises axially oriented gripping organs adapted to releasable engage into corresponding gripping organs in the second string part, the rotation lock also comprising a spring to provide an axial force on the rotation lock oriented from the first string part toward the corresponding gripping organs, and wherein the torque release coupling has an annular main shape to allow through flow of fluids and being provided in its upper and lower parts with coupling means for connecting to parts of a drill string, and further comprising a tightener for tightening the spring to adjust the torque release coupling.

10. Torque release coupling according to claim 1, wherein a room defined by the string parts is filled with oil.

11. Torque release coupling according to claim 8, wherein the spring is a helical spring.

* * * * *